US005829424A

United States Patent [19]

Hauser

[11] Patent Number: 5,829,424

[45] Date of Patent: Nov. 3, 1998

[54] DEVICE FOR WIRE SAWING PROVIDED WITH A SYSTEM FOR DIRECTING WIRE PERMITTING USE OF SPOOLS OF WIRE OF VERY GREAT LENGTH

[75] Inventor: Charles Hauser, Genolier, Switzerland

[73] Assignee: HCT Shaping Systems SA, Cheseaux, Switzerland

[21] Appl. No.: 724,927

[22] Filed: Oct. 2, 1996

[30] Foreign Application Priority Data

Oct. 3, 1995 [CH] Switzerland ..... 2777/95

[51] Int. Cl.[6] ..... B28D 1/06

[52] U.S. Cl. ..... 125/16.01; 125/16.02; 125/16.03; 242/361

[58] Field of Search ..... 125/16.02, 16.01, 125/16.03; 242/347.5, 361, 361.5

[56] References Cited

U.S. PATENT DOCUMENTS

| | | | |
|---|---|---|---|
| 778,059 | 12/1904 | De Miniszewski . | |
| 3,841,297 | 10/1974 | Mech . | |
| 3,843,072 | 10/1974 | Rayfield | 242/361 |
| 5,465,917 | 11/1995 | Kosch | 242/361 |
| 5,628,301 | 5/1997 | Katamachi | 125/13.01 |

FOREIGN PATENT DOCUMENTS

| | | | |
|---|---|---|---|
| 1591125 | 6/1970 | France . | |
| 36024180 | 12/1985 | Japan | 242/361 |
| 7-195263 | 8/1995 | Japan . | |

*Primary Examiner*—Robert A. Rose
*Assistant Examiner*—George Nguyen
*Attorney, Agent, or Firm*—Young & Thompson

[57] ABSTRACT

A sawing device comprises a layer of parallel wires (8) which move with reciprocal or continuous movement whilst bearing against a member (9) to be sawed fixed to a support table (10). The wire comes from a management region (41*a*) of the wire, constituted by two spools of wire, one (2*a*) a payout spool and the other (14*a*) a take-up spool, which do not rotate, but which have a revolving spooling and unspooling member (42) about the spools permitting rendering the sawing device independent of the mass of the spools of wire (2*a*, 14*a*) and hence of the length of the wire.

12 Claims, 5 Drawing Sheets

DEVICE FOR WIRE SAWING PROVIDED WITH A SYSTEM FOR DIRECTING WIRE PERMITTING USE OF SPOOLS OF WIRE OF VERY GREAT LENGTH

The present invention relates to a device for wire sawing comprising a sawing region in which a piece to be sawed bears against the wire adapted to be displaced by reciprocating or continuous movement to saw the piece and a device for directing the wire comprising a payout spool supplying new wire to the sawing zone and a take-up spool collecting the used wire from the sawing zone.

Known sawing devices comprise most often a layer of wires adapted to be displaced with continuous or reciprocating movement bearing against a piece to be sawed into slices, thereby defining a sawing region. The sawing region is constituted of an assembly of cylinders disposed in parallel. These cylinders, called wire guides, are engraved with grooves defining the interval between the wires of the layer, namely the thickness of the slices to be sawed. The piece to be sawed is fixed on a table support which moves perpendicularly to the layer of wires. The speed of movement defines the speed of cutting. The supply of the wire as well as the control of its tension takes place in a portion called a "wire management region" and is located outside the cutting region itself. The agent which controls the cutting is either an abrasive secured to the wire, or a loose abrasive through which the wire has been passed. The wire acts only as a carrier.

The wire used, even if it acts only as a carrier, is subjected to a certain wear which must be compensated by the replacement rate which will be defined by the surface sawed per unit time. The present development of wire sawing is directed toward the use of the technique for sawing large pieces, hence of large surfaces and as a result a high consumption of wire. The use of wires of great length becomes imperative.

Wire control systems now used in sawing devices are comprised by spools mounted horizontally or vertically on a power-driven axle whose speed is controlled by a device regulating the flow rate and tension of the wire via an electronic control. The wire will thus pass from a spool of new wire to the sawing region to return after use to a spool of used wire. In a large number of cases, a longitudinal dissymmetric reciprocatory movement is used, the dissymetry being used to adjust the rate of replacement. The longitudinal reciprocatory movement imposes on the spools of new wire and used wire frequent changes of direction with high accelerations. If it is not desired to increase the power of the motors beyond what is reasonable, the present limitation of these sawing devices is hence determined by the weight of the wire spools which must be accelerated or decelerated and as a result by the length of the wire which can be controlled in this manner. Another difficulty arises from the fact that the spool changes from its full weight to its empty weight in the course of working. This large variation of weight upsets regulatory systems and renders more difficult, if not impossible, the overall control. Moreover, if the length is limited, the changing of the wire must take place more frequently with as a result more manipulation and prolonged interruption of production time.

Wire sawing devices of the type recited above are already known particularly in the industry of electronic components, ferrites, ports and silica, to obtain thin slices of material such as polycrystalline or monocrystalline silica or new materials such as GaAs, InP, GGG (gadolinium-gallium garnet) or again quartz, synthetic sapphire, and ceramic materials. The high cost of these materials renders wire sawing more attractive in comparison to other techniques such as sawing by diamond disc. These wire sawing devices use a steel wire of a diameter generally comprised between 0.1 and 0.2 mm, typically 0.18 mm. The present length is comprised between 100 and 300 km hence a maximum weight of 60 kg, not including the support spool.

The precision of the pieces to be sawed, which is very important for electronic applications, depends on the supply of the wire and its consumption. The control of consumption permits controlling the wear on the wire adapted to increasing requirements of technology which permit the production of pieces to be sawed of greater diameter and greater length. This tendency requires a consumption control adapted to these new possibilities and as a result requires the use of wires of great length which are lees well adapted for present systems.

The objects of the present invention consists therefore in overcoming the limitations of the known sawing devices, which cannot use that limited length of wire, to suppress the inertia factor of the rotating spools during high accelerations and deceleration, to render possible very great lengths of wire and to obtain high sawing precision.

So as to achieve these objects, the device according to the present invention is characterized by the fact that the device for managing the wire comprises at least one rotatable member for unwinding and/or rewinding, mounted rotatably about the periphery of this spool and arranged so as to unwind and/or rewind the wire with an adjustable flow rate.

By these characteristics, the invention permits using heavy spools of wire having a large diameter without the use of high powered motors being necessary. This also permits working for long periods without human intervention, thereby improving the productivity and the quality. By the use of stationary spools, or in any case that do not rotate rapidly, and by rolling up or unrolling the wire by a device revolving about these latter, inertia is no longer dependent on the weight of the wire or of that of the spool, but only on that of the winding or unwinding device which can itself be made as light weight as possible. The lengths of wire will be limited only by market availability, and hence spools of 400 kg containing up to 2,000 km of wire of a diameter of 0.18 mm are made possible.

The use of non-rotating spools of wire therefore permits producing a wire sawing device having great independence of operation with very long length of wire, without the control system of the wire being affected by the mass of this latter. This permits having a more regular flow rate, obtaining higher speeds whilst keeping the operational advantages and a high precision of cutting.

A preferred embodiment is characterized by the fact that the wire is arranged in the sawing region in the form of a layer of parallel wires, by the fact that the two paying out and taking up bobbins are mounted non-rotatably on a support and that the wire management device comprises two rotatable members mounted to revolve about the two spools and arranged so as to act as regulators for the flow rate and tension of the wire.

There is thus obtained a sawing device of simple construction, reliable, rapid and precise operation which is entirely independent of the weight of the two spools of wire and comprising effective regulation of the flow rate and tension of the wire, which will be less complicated, and of a low precise.

Preferably, said rotatable member comprises a winding head mounted to revolve about the periphery of the spool and comprising at least one first return element arranged to guide the wire from or toward the spool in the direction of a second return element.

These characteristics permit a very precise and less complicated construction.

The second return element can preferably be arranged such that the wire will be disposed substantially on the axis of rotation of said rotating member which coincides with the axis of the spool and be arranged so as to guide the wire in the direction of the sawing region.

This arrangement ensures very favorable and precise conveying of the wire.

According to a particularly advantageous modification, the first return element comprises a first pulley of which a normal to the axis of rotation is substantially perpendicular to the axis of the spool about which it revolves and a second pulley whose axis of rotation is mounted rotatably about a shaft arranged such that the wire terminates substantially tangential to the spool no matter what the degree of fullness of this latter.

The wire can thus be rolled up and unrolled from beginning to end of the spool, very regularly and with a precise orientation.

In a preferred manner, the revolving member comprises an arm provided with said winding head and having for its axis of revolution the axis of the spool.

There is obtained by these characteristics a simple and low cost construction.

According to a modification, the revolving member can comprise a ring concentric with the spool and carrying said winding head driven by a motor in rotation on the ring.

According to another modification, the revolving member can comprise a ring concentric to the spool formed by a roller with two rings, the winding head being secured to one of the rings driven in rotation by a motor.

These modifications permit obtaining very precise and reliable winding.

Preferably, the operation of traversing the spools is effected by axial reciprocal movement of these latter by means of a mechanical, electrical, hydraulic or pneumatic drive means.

The wire can thus be rolled up in a very regular way on the spools. The reciprocatory movement along the axis of the spool is carried out with an amplitude which is equal to the length of filling defined by the distance between the flanges of the spool.

In conclusion, the sawing device will hence be present in the form of two modules, one containing the sawing region comprised by wire guide cylinders supporting the layer of wires and the support table which moves perpendicularly to the layer of wires, the other containing the wire control, which will be comprised by support for the spools on which will be disposed the paying out and collecting spools. These latter could be driven with reciprocatory movement to carry out the operation of traversing, namely the successive winding of wire against wire. With each of these wire spools is associated a winding or unwinding system revolving about the latter. This operation can be effected for example by a revolving arm centering on the axis of the spool having at its ends a pulley arrangement with various returns or by an external rail supporting a carriage with return pulleys.

Other advantages will become apparent from the characteristics set forth in the appended claims and the description given hereafter of the invention in greater detail with reference to the drawings which represent schematically and by way of example an embodiment and modifications.

Figure 1:
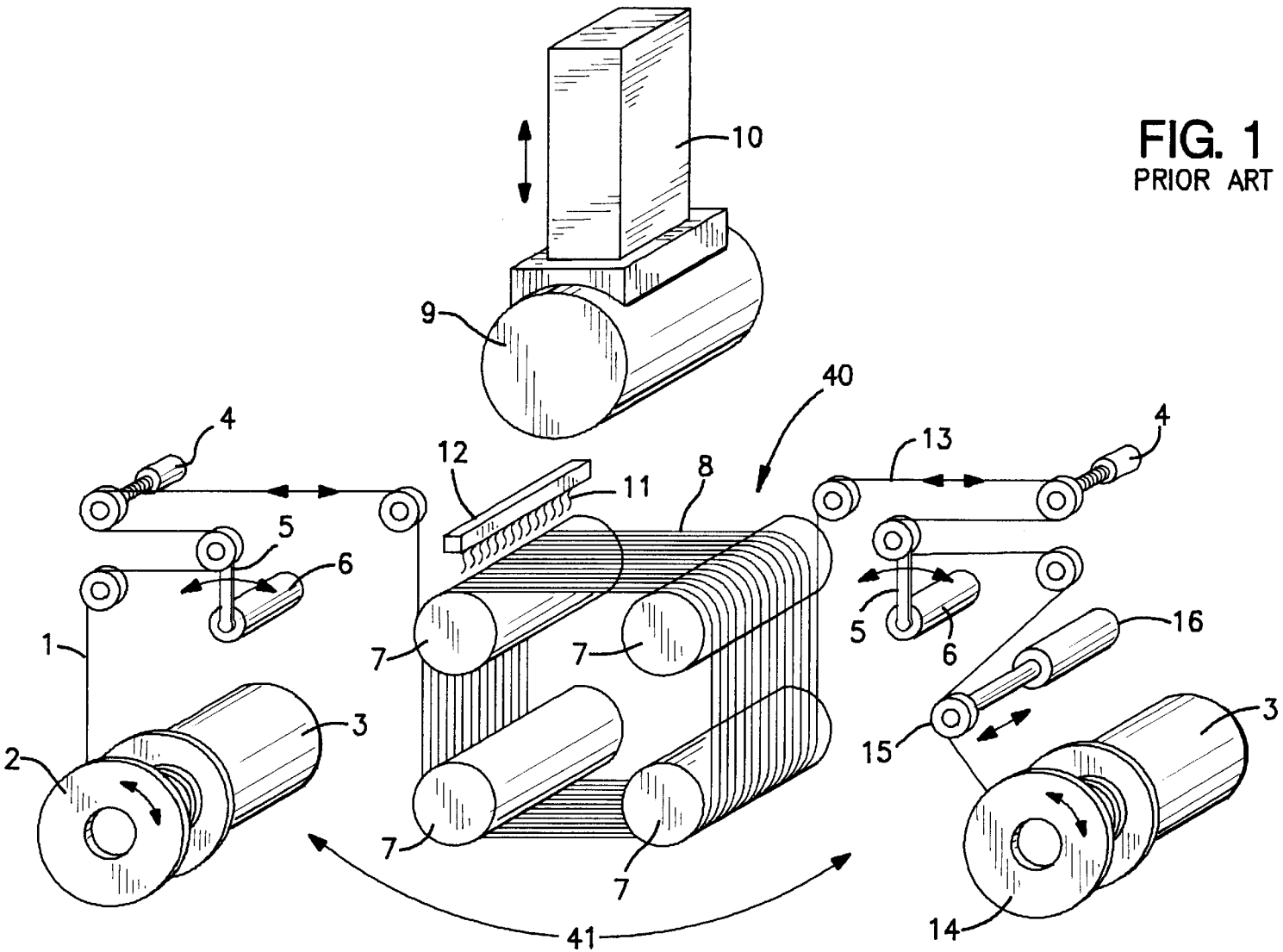
FIG. 1 PRIOR ART
FIG. 1 shows schematically a conventional sawing device, used prior to the present invention.

In the prior art shown in FIG. 1, the new wire 1 leaves the supply bobbin 2 which is driven by a rotor 3. A tension measurer 4 corrects a tensioning arm 5 coupled to a motor 6. The wire then passes into the sawing region 40, about wire guides 7 to form the sheet of wires 8. The piece 9 to be sawed, fixed to a support table 10, comes to bear against the latter to be sawed by the abrasive 11 from a distributor 12 and entrained by the wires of the layer 8. The used wire 13 leaves the layer and returns to the wind-up spool 14 by means of the tensioning arm 5, the tension measuring arm 4 and the traversing pulley 15 actuated with lateral reciprocatory movement by the motor 16. The management device 41 of the wire thus comprises spools 2 and 14 mounted rotatably about their axes.

Figure 2:
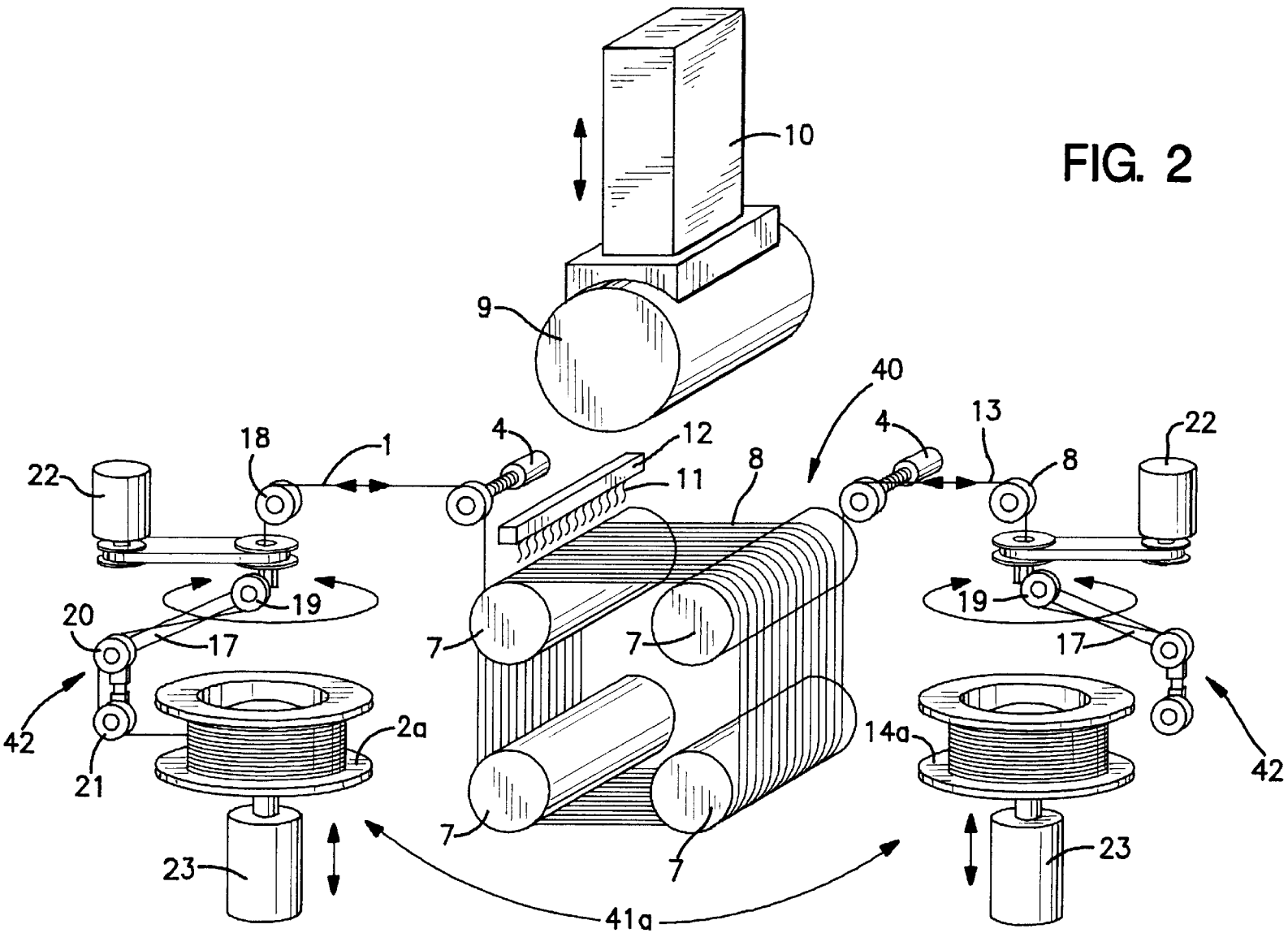
FIG. 2 is a schematic view of an embodiment of the sawing device according to the present invention.

FIG. 2 shows schematically an embodiment of the present invention. The new wire 1 leaves the supply spool 2*a* about which revolves an arm 17 supporting pulleys 18, 19, 20, 21. The motor of arm 22 supplies the tension to be applied to the wire 1, this tension being given by a measurement gauge 4. The wire 1 moves toward the sawing region 40 comprised by the same elements as in FIG. 1. The used wire returns to the wind-up bobbin 14*a* by means of the measurement gauge 4 and of the revolving arm 7. The pay-out bobbins 2*a* and take-up bobbins 14*a* can be driven with reciprocatory movement generated by a driven device 23 at the end of traversing. The management device 41*a* for the wire can be entirely reversible.

Thus, the spools 2*a* and 14*a* are mounted in a fixed manner, not rotatably, on any support. The arms 17 with their pulleys 18 to 21 each form a revolving means 42 for unwinding and/or rewinding, mounted so as to rotate about the periphery of the bobbins and arranged so as to unwind and/or rewind the wire with a flow rate adjustable by the speed of the motors 22. The measurement gauges 4 are connected to the control of the motors 22, such that the rotatable members 42 act as regulators of the flow rate and tension of the wire.

Figure 3:
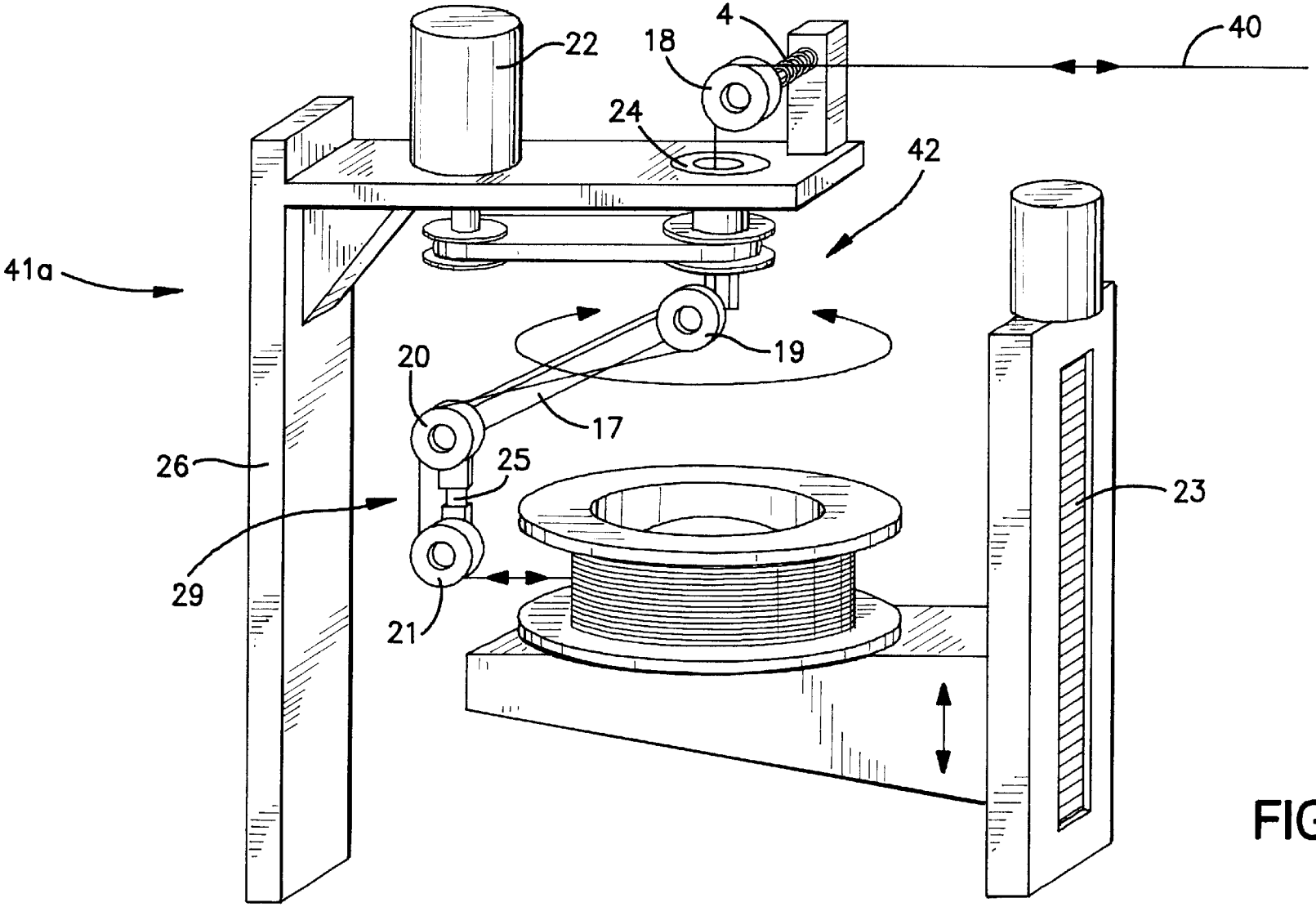
FIG. 3 is a schematic view of a detail of FIG. 2.

FIG. 3 shows one possibility for the construction of the wire control device 41*a* according to the invention. The wire enters by a pulley 18, fixedly oriented and coupled to the tension gauge 4, adjacent the sawing region 40. This latter passes through a bearing 24 to which is fixed the tension arm 17 driven by the tension and rotation motor 22 fixed on a support 26. It passes about pulleys 19 and 20 fixed relative to the arm and having parallel axes of rotation. The output pulley 21 can rotate relative to the shaft 25 to maintain a fixed orientation relative to the wire according to the degree of filling of the receiving spool 14. The bearing 24 supports the revolving arm 17 with its system of pulleys. The spool is driven with a back-and-forth movement generated by the mechanism 23, which could be electric, hydraulic, pneumatic, etc.

The pulleys 20, 21 thus form a winding head 29 mounted so as to revolve about the periphery of one of the spools 2*a*, 14*a*. The pulley 21 constitutes a return member adapted to guide the wire from or to the spool in the direction of the pulley 20. This latter guides the wire toward the pulleys 19 and 18 which are arranged such that the wire will be disposed substantially on the axis of rotation of the bearing 24, coinciding with the axis of the spool. From the pulley 18, the wire then passes to the sawing region 40.

The pulley 20 has an axis of rotation such that the normal to this axis is substantially perpendicular to the axis of the spool. As the pulley 21 turns relative to the shaft 25, the wire terminates in a substantially tangential fashion to the pulley no matter what the degree of filling of this latter.

Figure 4:
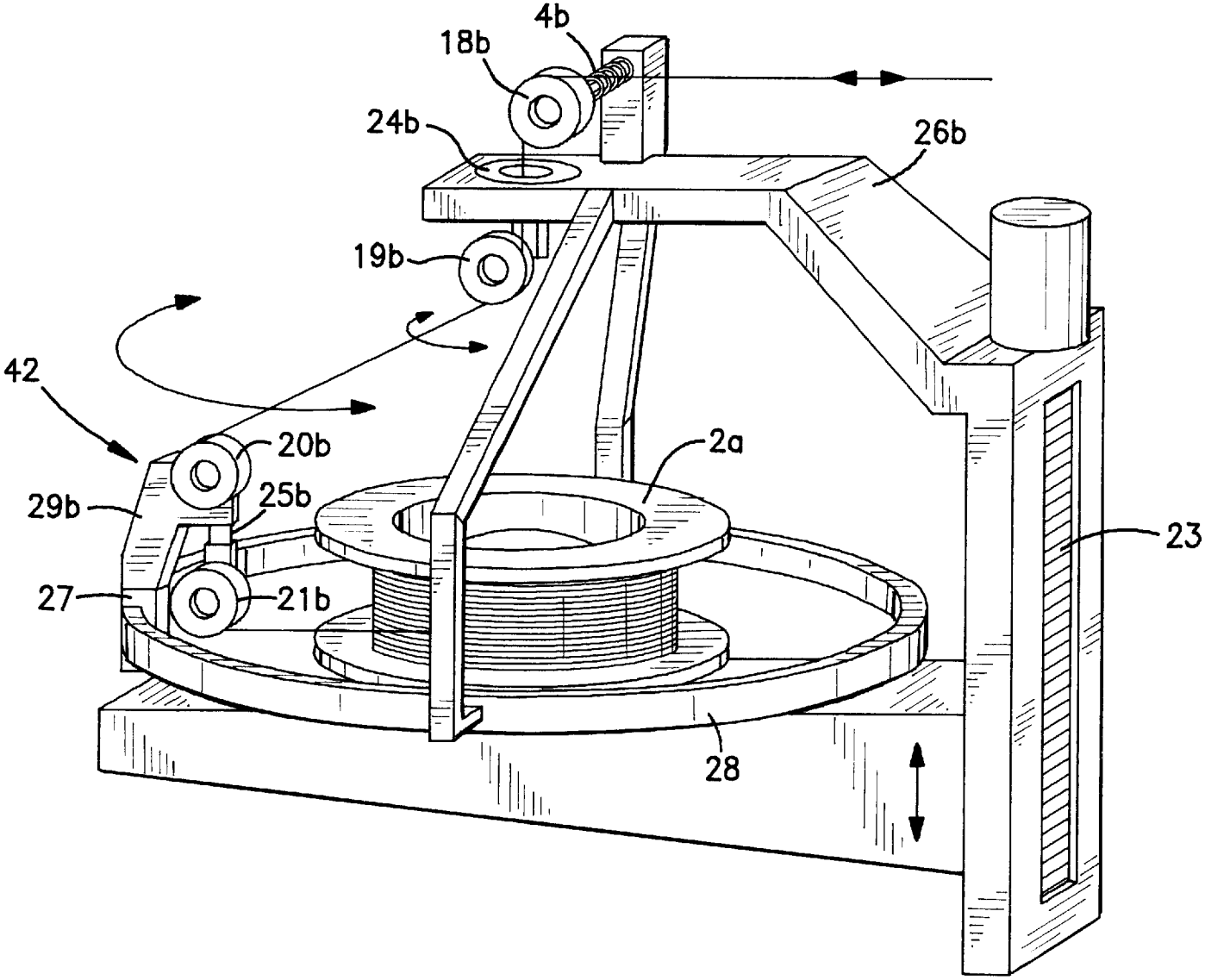
FIGS. 4 and 5 are schematic views of two modifications.

FIG. 4 shows a modification permitting carrying out the function whilst using a linear motor 27 that rotates on a ring or on a circular rail 28 concentric with the spool 2*a*. The carriage 29*b* of the linear motor 27 forming the spooling head supports the necessary pulleys 20*b* and 21*b*. The pulley 18*b* coupled to the tension gauge 4*b*, as well as the bearing 24*b*, are mounted fixedly on the support 26*b* and the pulley 19*b* rotatably relative to the pulley 18*b* is fixed on the bearing 24*b*. The pulley 21*b* is mounted rotatably on the shaft 25*b*, whilst the pulley 20*b* comprises an axis of rotation fixed relative to the carriage 29*b*.

Figure 5:
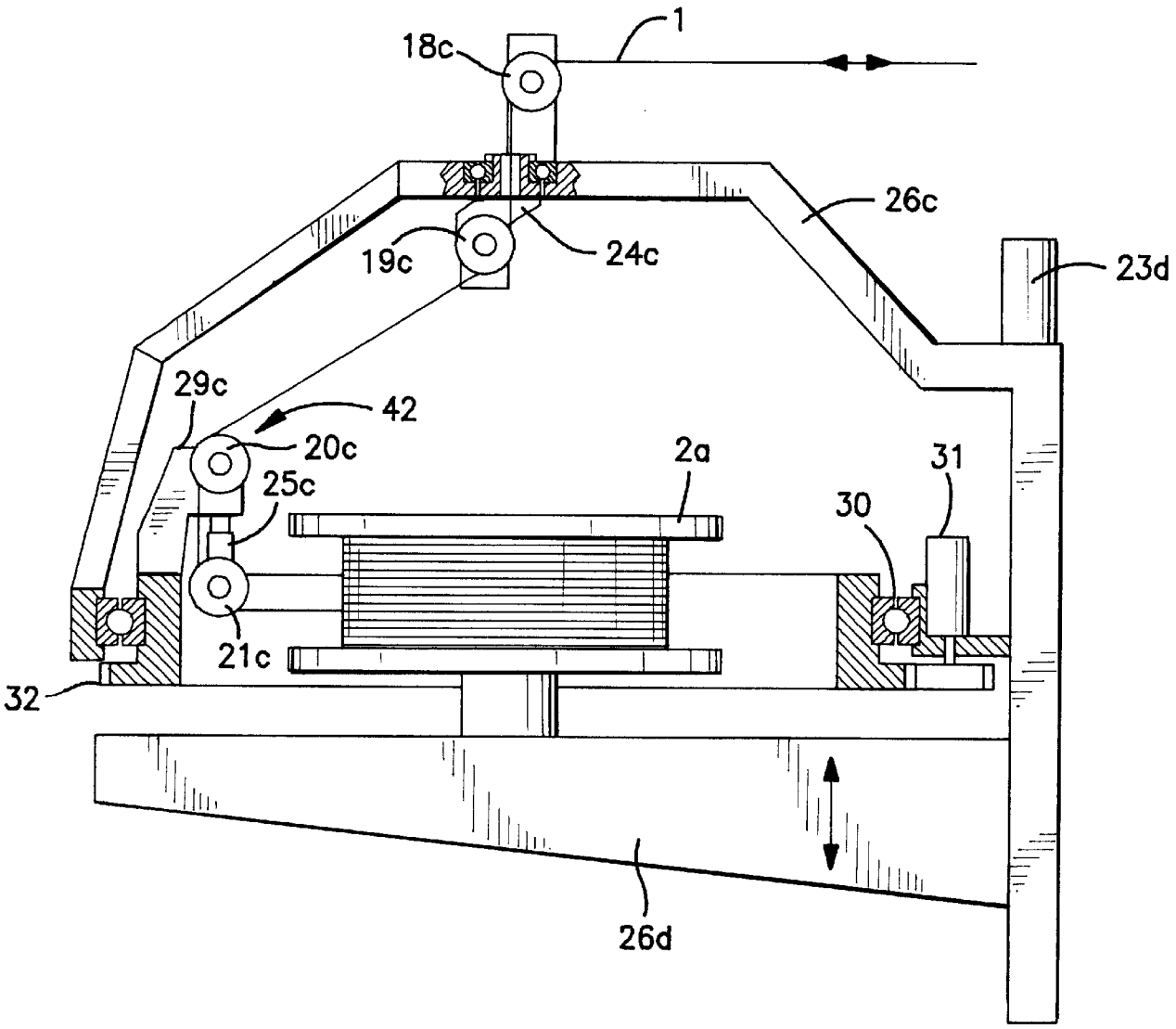

The second modification shown in FIG. 5 comprises the support 26*c* and movable support arm 26*d* carrying the fixed spool 2*a*, which does not rotate. Thanks to the motor 23*d*, which can be of the mechanical, electrical, hydraulic, pneumatic or other type, the support arm 26*d* can be displaced vertically to effect the function of traversing, corresponding to a reciprocating transverse axial movement of the spool so as to wind up the wire progressively. A ring concentric to the spool is formed by a roller bearing 30 comprising two rings. The winding head 29*c* is mounted on the internal ring 32 driven in rotation by the motor 31, for example as a function of signals received from the tension gauge or from another control element.

As described above, the pulleys 18*c* and 20*c* have axes of rotation whose orientation is fixed relative to the support 26*c*, respectively to the winding head 29*c*, whilst the pulleys 19*c* and 21*c* are mounted to revolve relative to the support 26*c* thanks to the bearing 24*c*, and respectively relative to the winding head 29*c* thanks to the shaft 25*c*.

According to a third modification, the spools 2*a*, 14*a* could be mounted to revolve on their support arms 26*d* (FIG. 5) and be driven in rotation to cause the wire to move with a continuous flow rate from the output spool toward the intake spool. There would thus be a first reciprocating sawing movement of the wire obtained thanks to the revolving members 42 with their winding head 29 and a second continuous rewinding movement of the wire on the receiving spool to compensate wear of this latter. The reciprocating sawing movement could thus have a higher speed, for example 20 m/sec, than that of the continuous movement, for example 1 to 2 m/sec.

Generally speaking, the sawing wire forming the layer of wires 8 is constituted of spring steel of a diameter comprised between 0.1 and 0.2 mm so as to saw blocks of hard material or more particular compositions such as silica, ceramic, comprised of Group III–V, GGG, sapphire, etc., in slices of about 0.1 to 5 mm thickness. The abrasive agent is a commercial product and can be diamond, silicon carbide, alumina, etc., in a form fixed to the wire or in loose form picked up from a supply.

The sawing device permits the use of heavy spools 2*a*, 14*a*, containing great lengths of wire, rationalizing the operation of sawing and cutting off pieces 9 to be sawed of large diameters whilst obtaining the necessary precision. Moreover, the general concept of the machine is simplified, permitting obtaining for the user a lower capital cost and more economical operation.

Of course the embodiment and modifications described above are in no way limiting and can be the subject of any desirable modification within the framework defined by claim 1. In particular, the sawing device could have, in the sawing region, only a single wire, instead of a layers of wires. It could also comprise a single non-rotating spool either as the payout spool or as the receiving spool and another device for is wire management at the other end, for example a single flanged conical spool. The operation of traversing the spools could also be carried out by reciprocatory transverse movement of the spooling head parallel to the axis of the spools. The pulleys 18 to 21 could be replaced by any other suitable guide and return member. The orientation of the axis of the spools 2*a*, 14*a* could be different, vertical or inclined.

What is claimed is:

1. A device for wire sawing comprising: a sawing region (40), said sawing region comprising a layer (8) of parallel wires disposed on at least two guide cylinders (7) in which a piece (9) to be sawed bears against said layer (8), said layer of wires adapted to be displaced with reciprocal or continuing movement to saw a piece bearing against said layer; and a wire management device (41*a*) comprising a payout spool (2*a*) for supplying new wire (1) to said sawing region (40) and a take-up spool (14*a*) for taking up the used wire from said sawing region, said payout spool (2*a*) mounted non-rotatably on a support, said wire management device (41*a*) further comprising a revolving unspooling member (42) mounted to revolve about said non-rotatable payout spool (2*a*) and arranged so as to unwind the wire with an adjustable flow and to act as a regulator of flow rate and tension of the wire (1).

2. The device according to claim 1, wherein said take-up spool (14*a*) is mounted non-rotatably on a support and said management device (41*a*) comprises a revolving respooling member mounted to revolve about said non-rotatable take-up spool (14*a*).

3. A sawing device according to claim 1, wherein said rotatable member (42) comprises a spooling head (29) mounted to revolve about the periphery of a said spool and comprising at least one first return element (20, 21) arranged to guide the wire from or to the spool in the direction of a second return element (18, 19).

4. A sawing device according to claim 3, wherein the second return element (18, 19) is arranged such that the wire is disposed substantially on the axis of rotation of said rotatable member (42) coinciding with the axis of the spool (2*a*, 14*a*) and arranged so as to guide the wire in the direction of the sawing region (40).

5. A sawing device according to claim 3, wherein the first return element comprises a first pulley (20) of which a normal to whose axis of rotation is substantially perpendicular to the axis of the spool (2*a*, 14*a*) about which it revolves and a second pulley (21) whose axis of rotation is mounted to revolve about a shaft (25) arranged such that the wire will end in a substantially tangential manner at the spool (2*a*, 14*a*) no matter what the degree of fullness of the spool.

6. A sawing device according to claim 5, wherein the second return element comprises a third pulley (19) mounted to revolve on a support such that its axis of rotation is substantially parallel to the axis of rotation of the first pulley (20) and a fourth pulley (18) arranged so as to guide the wire in the direction of the sawing region (40).

7. A sawing device according to claim 3, wherein the rotatable member (42) comprises an arm (17) provided with said winding head (29) and having for its axis of rotation the axis of the spool.

8. A sawing device according to claim 3, wherein the rotatable member (42) comprises a carriage (29*b*) forming said spooling head rotatable mounted and driven by a motor (27) in rotation on a circular rail (28) concentric to the spool (2*a*).

9. A sawing device according to claim 1, wherein the wire management device (41*a*) is arranged so as to effectuate a first reciprocating movement of the wire saw obtained by the action of said rotatable member (42) and by the spools mounted to move on supports to effect a second rewinding movement of the used wire on the take-up spool.

10. In a device for wire sawing comprising a sawing region (40) in which a piece (9) to be sawed bears against a wire (1) adapted to be displaced with reciprocal or continuing movement to saw the piece and a wire management device (41*a*) comprising a payout spool (2*a*) supplying new wire to the sawing region (40) and a take-up spool (14*a*) taking up the used wire from the sawing region; the improvement wherein the wire management device (41*a*) comprises at least one revolving unspooling or respooling member (42) mounted to revolve about the periphery of a said spool (2*a*, 14*a*) and arranged so as to unwind or rewind the wire with an adjustable flow rate, wherein said revolving member (42) comprises a spooling head (29) mounted to revolve about the periphery of a said spool, at least one first return element (20, 21) arranged to guide the wire from or to the spool in the direction of a second return element (18, 19), and a ring concentric to the spool formed by a roller (30) with two rings, the spooling head (29*c*) being secured on one (32) of the rings driven in rotation by a motor (31).

11. In a device for wire sawing comprising a sawing region (40) in which a piece (9) to be sawed bears against a wire (1) adapted to be displaced with reciprocal or continuing movement to saw the piece and a wire management device (41*a*) comprising a payout spool (2*a*) supplying new wire to the sawing region (40) and a take-up spool (14*a*) taking up the used wire from the sawing region; the improvement wherein the wire management device (41*a*) comprises at least one revolving unspooling or respooling member (42) mounted to revolve about the periphery of a said spool (2*a*, 14*a*) and arranged so as to unwind or rewind the wire with an adjustable flow rate, wherein a traversing function of the wire on the spools (2*a*, 14*a*) is carried out by an axial reciprocal movement of the spools by means of a drive means (23).

12. In a device for wire sawing comprising a sawing region (40) in which a piece (9) to be sawed bears against a wire (1) adapted to be displaced with reciprocal or continuing movement to saw the piece and a wire management device (41*a*) comprising a payout spool (2*a*) supplying new wire to the sawing region (40) and a take-up spool (14*a*) taking up the used wire from the sawing region; the improvement wherein the wire management device (41*a*) comprises at least one revolving unspooling or respooling member (42) mounted to revolve about the periphery of a said spool (2*a*, 14*a*) and arranged so as to unwind or rewind the wire with an adjustable flow rate, wherein a traversing function of the spools is effected by axial reciprocating movement of a spooling head (29) parallel to the axis of the spools (2*a*, 14*a*).

* * * * *